US010724831B1

(12) United States Patent
Walker

(10) Patent No.: US 10,724,831 B1
(45) Date of Patent: Jul. 28, 2020

(54) FIBROUS OCCLUSIVE INTERRUPTION OF LIFT

(71) Applicant: Leidos, Inc., Reston, VA (US)

(72) Inventor: Howard Walker, San Diego, CA (US)

(73) Assignee: Leidos, Inc., Reston, VA (US)

( * ) Notice: Subject to any disclaimer, the term of this patent is extended or adjusted under 35 U.S.C. 154(b) by 0 days.

(21) Appl. No.: 16/161,210

(22) Filed: Oct. 16, 2018

Related U.S. Application Data

(60) Provisional application No. 62/572,620, filed on Oct. 16, 2017.

(51) Int. Cl.
*F41H 13/00* (2006.01)
*F41H 11/02* (2006.01)
*F42B 12/56* (2006.01)

(52) U.S. Cl.
CPC ..... *F41H 11/02* (2013.01); *F42B 12/56* (2013.01)

(58) Field of Classification Search
CPC ..... F41H 11/02; F41H 11/04; F41H 11/05; F41H 11/06; F41H 13/0006; F42B 12/66; F42B 12/68; F42B 12/70; F42B 12/56; F42B 12/58
USPC ..... 102/504, 505; 89/1.34, 1.11
See application file for complete search history.

(56) References Cited

U.S. PATENT DOCUMENTS 2,308,683 A * 1/1943 Forbes ..... F41H 11/04 102/504
2,352,502 A * 6/1944 Smith ..... F42B 12/66 102/504
2,368,587 A * 1/1945 Wise ..... F41H 11/04 102/504
2,372,383 A * 3/1945 Lee ..... F41H 11/04 102/504
2,374,261 A * 4/1945 Ames ..... F41H 11/04 102/405
3,468,117 A * 9/1969 Cannon ..... D02G 1/00 57/246
3,760,735 A * 9/1973 Schmitt ..... F42B 7/04 102/451

(Continued)

FOREIGN PATENT DOCUMENTS

EP 2679713 A1 1/2014 ..... D04H 3/12

OTHER PUBLICATIONS

American Society for Testing and Materials (ASTM) Standard D2256M-10, Standard Test Method for Tensile Properties of Yarns by the Single-Strand Method, Jul. 2010, 13 pp.

(Continued)

*Primary Examiner* — Derrick R Morgan
(74) *Attorney, Agent, or Firm* — Dawn-Marie Bey; Bey & Cotropia PLLC

(57) ABSTRACT

A system and process for interfering with the flight of one or more unmanned aerial vehicles (UAVs) includes aiming a deployment device in a direction of the one or more UAVs and deploying by the deployment device a package in the direction of the one or more UAVs. The package includes a fiber material consisting of multiple individual fibers formed of one or more biodegradable materials. When the fiber material is released from the package after deployment, it forms a cloud of multiple individual fibers and the cloud of multiple individual fibers physically interferes with a propeller system of the one or more UAVs, thus causing the one or more UAVs to lose the ability to remain aloft.

18 Claims, 8 Drawing Sheets

(56) References Cited

U.S. PATENT DOCUMENTS 4,149,166 A * 4/1979 Null ..... F41G 7/301 102/505
4,327,644 A * 5/1982 Stancil ..... F41H 11/02 102/504
4,656,945 A * 4/1987 Stancil ..... F42B 12/66 102/405
5,279,482 A * 1/1994 Dzenitis ..... B64G 1/648 102/504
5,389,166 A * 2/1995 White ..... B09B 1/00 112/420
5,706,795 A * 1/1998 Gerwig ..... F41B 11/62 124/71
5,783,505 A * 7/1998 Duckett ..... D04H 1/54 156/308.2
5,807,024 A * 9/1998 Benedict ..... E02B 3/18 256/12.5
5,814,753 A * 9/1998 Rieger ..... F42B 12/66 102/293
6,381,894 B1 * 5/2002 Murphy ..... F41A 21/32 42/77
6,579,814 B1 6/2003 Lindquist et al. ..... 442/347
6,610,900 B1 8/2003 Tanzer ..... 604/368
6,677,038 B1 * 1/2004 Topolkaraev ..... D01F 8/06 428/370
8,176,867 B2 * 5/2012 Gayton ..... B63G 13/00 114/240 D
8,920,825 B2 12/2014 Benaddi et al. ..... 424/406
10,197,365 B1 * 2/2019 Blyskal ..... F42B 12/68
2001/0032577 A1 * 10/2001 Swartout ..... B63B 21/56 114/254
2002/0074697 A1 6/2002 Steinke et al. ..... 264/504
2005/0075043 A1 * 4/2005 Lorenzana ..... A63H 37/00 446/475
2006/0012072 A1 * 1/2006 Hagewood ..... D01D 4/06 264/176.1
2006/0083917 A1 * 4/2006 Dugan ..... D01F 8/04 428/364
2007/0287981 A1 * 12/2007 Roe ..... A61F 13/49413 604/385.28
2009/0026401 A1 1/2009 Dobkins ..... 251/149.6
2009/0084284 A1 * 4/2009 Martinez ..... B63G 9/04 102/504
2010/0132580 A1 * 6/2010 Nazdratenko ..... F41H 13/0006 102/502
2010/0242777 A1 * 9/2010 Schneider ..... F42B 12/68 102/504
2010/0269675 A1 * 10/2010 Larkin ..... B63G 8/001 89/1.11
2010/0300346 A1 * 12/2010 Gayton ..... B63G 13/00 114/382
2011/0005373 A1 * 1/2011 Martinez ..... B63G 9/04 89/1.34
2011/0174140 A1 * 7/2011 Brewer ..... B63B 1/32 89/1.34
2011/0220087 A1 * 9/2011 Gerwig ..... F41B 11/62 124/57
2012/0164905 A1 6/2012 Topolkaraev et al. ..... 442/364
2013/0037163 A1 * 2/2013 Teshima ..... D02G 3/406 139/391
2013/0101805 A1 4/2013 Altshuler et al. ..... 428/172
2014/0331984 A1 * 11/2014 Brahler, II ..... F41B 11/723 124/76
2016/0023760 A1 * 1/2016 Goodrich ..... B64C 11/48 244/10
2016/0375384 A1 * 12/2016 Amirnasr ..... B01D 39/04 210/505
2016/0376029 A1 * 12/2016 Sekiya ..... F41H 11/02 244/110 F
2017/0144756 A1 * 5/2017 Rastgaar Aagaah ..... B64C 39/024
2017/0219317 A1 * 8/2017 Sands ..... F41H 11/02
2017/0261292 A1 * 9/2017 Armstrong ..... F42B 12/56
2017/0321996 A1 * 11/2017 Hoareau ..... F41H 13/00
2017/0352963 A1 * 12/2017 Hurzon ..... F41J 2/00
2017/0356726 A1 * 12/2017 Theiss ..... F41H 13/0006
2018/0094908 A1 * 4/2018 Down ..... F41H 13/0006
2018/0162529 A1 * 6/2018 Klein ..... B64C 39/02
2018/0245888 A1 * 8/2018 Banga ..... F41H 11/02
2018/0266793 A1 * 9/2018 Wahle ..... F41H 11/02
2018/0283828 A1 * 10/2018 Teetzel ..... F41H 13/0006
2018/0292184 A1 * 10/2018 Down ..... F41H 11/02
2018/0372456 A1 * 12/2018 Norris ..... F41H 13/0006
2019/0119831 A1 * 4/2019 Pinoca ..... A61F 13/51121
2019/0129427 A1 * 5/2019 Sugaki ..... B64C 39/02
2019/0134271 A1 * 5/2019 Seo ..... A61L 27/3834
2019/0168420 A1 * 6/2019 Reese ..... B29B 15/14
2019/0285388 A1 * 9/2019 Klar ..... B64C 39/024
2019/0360783 A1 * 11/2019 Whittaker ..... G05D 1/0022
2020/0108922 A1 * 4/2020 Smith ..... G05D 1/101
2020/0108925 A1 * 4/2020 Smith ..... G05D 1/101

OTHER PUBLICATIONS

ASTM Standard D2731-07 (Reapproved 2012)—Standard Test Method for Elastic Properties of Elastomeric Yarns (CRE Type Tensile Testing Machines), Aug. 2012, 5 pp.
ASTM Standard D6691—Standard Test Method for Determining Aerobic Biodegradation of Plastic Materials in the Marine Environment by a Defined Microbial Consortium or Natural Sea Water Inoculum, Dec. 2009.
ASTM Standard D7473-12—Standard Test Method for Weight Attrition of Plastic Materials in the Marine Environment by Open System Aquarium Incubations, Jun. 2012, 4 pp.
ASTM Standard D5511-12—Standard Test Method for Determining Anaerobic Biodegradation of Plastic Materials Under High-Solids Anaerobic-Digestion Conditions, 2012, 7 pp.
ASTM Standard D5988-12—Standard Test Method for Determining Aerobic Biodegradation of Plastic Materials in Soil, 2012, 6 pp.
ASTM Active Standard Astm D570-98 (reapproved 2010)—Standard Test Method for Water Absorption of Plastics, 2010, 4 pp.
Eden Research Laboratory, "Update—Leidos—ASTM D5511 (38 Days)," Feb. 12, 2015, 2 pp.
Eden Research Laboratory, "Update—Leidos—ASTM D5988 (78 Days), " Mar. 4, 2015, 1 p.
"Polymer Kelp for Vessel Stopping/Draft White Paper/Refinement of Polymer Kelp Material for Deployment," Leidos, Surveillance and Reconnaissance Business Unit, Contract No. W91CRB-11-D-0001-0067, 10 pp., Feb. 25, 2015.
"Polymer Kelp for Vessel Stopping/Model Scale Material Specifications," Leidos, Surveillance and Reconnaissance Business Unit, Contract No. W91CRB-11-D-0001-0067, 13 pp., Feb. 23, 2015.
"Polymer Kelp for Vessel Stopping/Laboratory Test Plan for Developing Polymer Kelp Material," Leidos, Surveillance and Reconnaissance Business Unit, Contract No. W91CRB-11-D-0001-0067, 7 pp., Feb. 11, 2015.
"Intermediate Scale Material Specification," 5 pp., Aug. 26, 2014.
"Full Scale Material Specifications," 2 pp.
"Polymer Kelp for Vessel Stopping/vol. 1, Technical Proposal," Leidos, Contract No. W91CRB-11-D-0001, 12 pp., Mar. 7, 2014.
"An In-Scope Proposal for: Polymer Kelp Vessel Stopping/Technical Proposal," Leidos, Inc., Contract No. W91CRB-11-D-0001, Task Order 0067, 10 pp., Aug. 29, 2014.
Kaiyan Qiu and Anil N. Netravali, "Polyvinyl Alcohol Based Biodegradable Polymer Nanocomposites" [online], Biodegradable Polymers, vol. 1, ISBN: 978-1-63483-632-6, EBSCO Publishing, eBook Collection (EBSCOhost), Copyright 2015 [printed on Feb. 23, 2016}, via Judson College, 56 pp.
Maier, C., et al., "Polypropylene—The Definitive User's Guide and Databook—7.5 Spunbonded and Melt-Blown," William Andrew Publishing/Plastics Design Library, Retrieved from https://app.knovel.com/hotlink/pdf/id:kt0019N625/polypropylene-definitive/spunbonded-melt-blown, 1998.
Hankyoreh, hani.co.kr, "Safety Measures Announced in Advance of Pyeongchang Olympics" [online], Jan. 30, 2018 [retrieved on Sep. 24, 2018], 5 pp., Retrieved from the Internet: http://english.hani.co.kr/arti/PRINT/830072.html.

(56) References Cited

OTHER PUBLICATIONS

DroneShield, "Counterdrone Handbook," 7 pp., Apr. 2018.
David Von Drehle, "The Security Threat We've Been Ignoring: Terrorist Drones" [online], The Washington Post, Sep. 29, 2017 [retrieved on Sep. 24, 2018], Retrieved from the Internet: https://www.washingtonpost.com/opinions/the-security-threat-were-ignoring-terrorist-drones/2017/09/29/3fbd1374-a51f-11e7-b14f-f41173cd5a14_story.html?utm_term=.1f00f877a2af.
Kirstjen M. Nielsen, "The U.S. Isn't Prepared for the Growing Threat of Drones" [online], The Washington Post, Jul. 4, 2018 [retrieved on Sep. 24, 2018], 4 pp., Retrieved from the Internet: https://www.washingtonpost.com/opinions/the-us-isnt-prepared-for-the-growing-threat-of-drones/2018/07/04/30cc2a76-7eef-11e8-b9f0-61b08cdd0ea1_story.html?utm_term=.0b778c71ac4a.
Bernard Hudson, "Drone Attacks are Essentially Terrorism by Joystick" [online], The Washington Post, Aug. 5, 2018 [retrieved on Sep. 24, 2018], 4 pp., Retrieved from the Internet: https://www.washingtonpost.com/opinions/drone-attacks-are-essentially-terrorism-by-joystick/2018/08/05/f93ec18a-98d5-11e8-843b-36e177f3081c_story.html?utm_term=.650c35eb3a3f.
Drone Defence, "Net Gun X1," 4 pp., Copyright 2016.
OpenWorks Engineering, Ltd., "SkyWall, Capture Drones—Protect Assets," 15 pp.
Kelsey D. Atherton, "No One Knows the Best Way to Stop a Drone" [online], Feb. 2017 [retrieved on Oct. 4, 2017], 4 pp., Retrieved from the Internet: https://www.popsci.com/how-to-stop-a-drone.
Douglas Starr Security, "This Brilliant Plan Could Stop Drone Terrorism. Too Bad It's Illegal" [online], Feb. 28, 2017 [retrieved on Oct. 4, 2017], 10 pp., Retrieved from the Internet: https://www.wired.com/2017/02/sky-net-illegal-drone-plan.

* cited by examiner

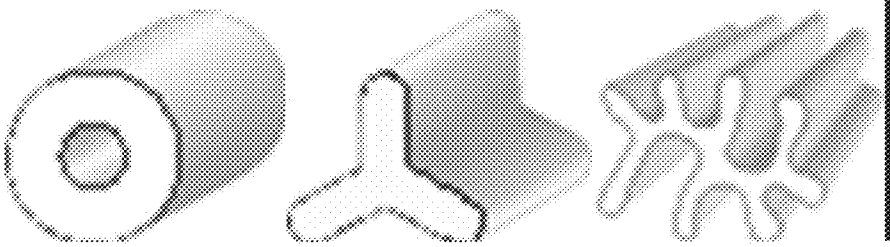
Hollow
Figure 4a
Trilobal
Figure 4b
Octalobal
Figure 4c
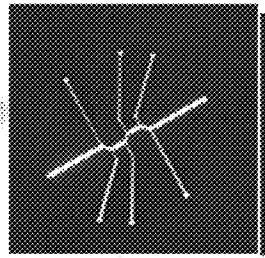
Starfish
Figure 4d
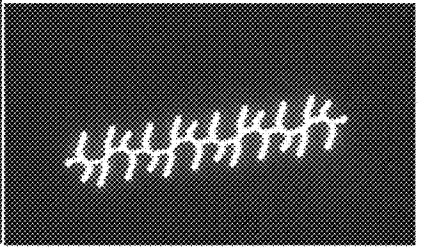
Caterpillar
Figure 4e

FIBROUS OCCLUSIVE INTERRUPTION OF LIFT

CROSS-REFERENCE TO RELATED APPLICATIONS

The present application claims the benefit of priority to similarly titled U.S. provisional patent application No. 62/572,620 filed Oct. 16, 2017, the entirety of which is incorporated herein by reference.

BACKGROUND

Field of the Embodiments

The present embodiments are generally directed to systems and methods for disrupting drone operation and are more particularly directed to systems and methods incorporating environmentally-friendly materials for disrupting the lift mechanism of Unmanned aerial vehicles or systems (UAVs or UASs) during flight.

Description of Related Art

Unmanned aerial vehicles or systems (UAVs or UASs), commonly referred to as drones, are becoming increasingly popular and more readily accessible. While there are numerous uses for UAVs that bring a net positive to society, they remain a risk when used for nefarious purposes (e.g., by enemies or terrorists) or by inexperienced users. The following articles discuss the growing threat to the military, civilians and infrastructure from drones which may be used to carry, e.g., explosives and/or biological or chemical weapons: Hudson, "Drone Attacks are Essentially Terrorism by Joystick," The Washington Post, Aug. 5, 2018; Nielsen, "The U.S. Isn't Prepared for the Growing Threat of Drones," The Washington Post, Jul. 4, 2018; and Von Drehle, "The Security Threat We've been Ignoring: Terrorist Drones," The Washington Post, Sep. 29, 2017. The contents of these articles in incorporated herein by reference.

Responsive to threats from drones, various UAV removal techniques have been suggested and tested, but many remain illegal due to the risk of collateral damage to persons, property and the environment. For example, the article in the Feb. 28, 2017 issue of Wired magazine by Douglas Starr, "THIS BRILLIANT PLAN COULD STOP DRONE TERRORISM. TOO BAD IT'S ILLEGAL," describes technology which uses frequency jamming technology to block UAV control signals. And a February 2017 article in Popular Science written by Kelsey Atherton suggests that "No one knows the best way to stop a drone" even though the article lists myriad of possible solutions including: net guns; drones carrying nets; squads of drones with nets; drones with net guns; smart anti-drone bazooka that fires a net at a drone; vaporware drone that ensnares the propellers of other drones with wire; a microwave gun to fry the electronics of hostile drones; lasers; signal jamming; cyber rifles. DroneShield's "Counterdrone Handbook" dated April 2018 also offers a summary of various anti-drone solutions.

These different anti-drone defenses generally fall into two categories: mechanical disruption and electromagnetic disruption. By way of example, a number of proposed and implemented mechanical disruption technologies utilizes physical nets to capture drones. The SkyWall system from OpenWorks Engineering provides ground-based or hand-held launchers for pneumatically launching projectiles, including nets, to capture drones. Various details about the SkyWall product are described in the SkyWall Capture Drones-Protect Assets brochure which is incorporated herein by reference. Similarly, the company Drone Defence offers the Net Gun X1 which can be used to project a net for drone capture. But nets suffer from the disadvantage of targeting. The net must be precisely aimed in order to be effective. Some aiming technologies rely on known radio control channels which are used by the drones for operations, but with advances in inertial navigation systems, these channels may no longer be used by drones, thus eliminating this avenue for targeting. Similarly, many of the current electromagnetic (EM) disruption strategies are based on the disruption or jamming of one or more types of EM signals upon which drones rely for operation (e.g., radio) and navigation (e.g., GPS). But with advances in autonomous operation, many of these EM signals are no longer used. Accordingly, there remains a need in the art for the effective and safe removal of UAVs from the sky in instances where they pose a threat to life and property.

SUMMARY OF EMBODIMENTS

In a first embodiment, a process for interfering with the flight of one or more unmanned aerial vehicles (UAVs), includes: aiming a first deployment device in a direction of the one or more UAVs; deploying by the first deployment device at least a first package in the direction of the one or more UAVs, wherein the first package includes a fiber material consisting of multiple individual fibers formed of one or more biodegradable materials, and further wherein the fiber material is released from the first package after deployment forming a cloud of multiple individual fibers, said cloud of multiple individual fibers physically interfering with a propeller system of the one or more UAVs and causing the one or more UAVs to lose the ability to remain aloft.

In a second embodiment, system for interfering with the flight of one or more unmanned aerial vehicles (UAVs), includes: a deployment device; a package for deployment by the deployment device, the package including a fiber material consisting of multiple individual fibers formed of one or more biodegradable materials, and wherein the fiber material is released from the package after deployment by the deployment device for forming a cloud of multiple individual fibers, said cloud of multiple individual fibers physically interfering with a propeller system of the one or more UAVs and causing the one or more UAVs to lose the ability to remain aloft.

BRIEF DESCRIPTION OF THE FIGURES

The following figures are intended to represent exemplary embodiments and should be considered in combination with the detailed description below.

FIG. 4*a*, 4*b*, 4*c*, 4*d*, 4*e* shows exemplary extrusion patterns for the FOIL fibers useful in one or more embodiments herein.

DESCRIPTION OF THE EMBODIMENTS

Figure 1A:
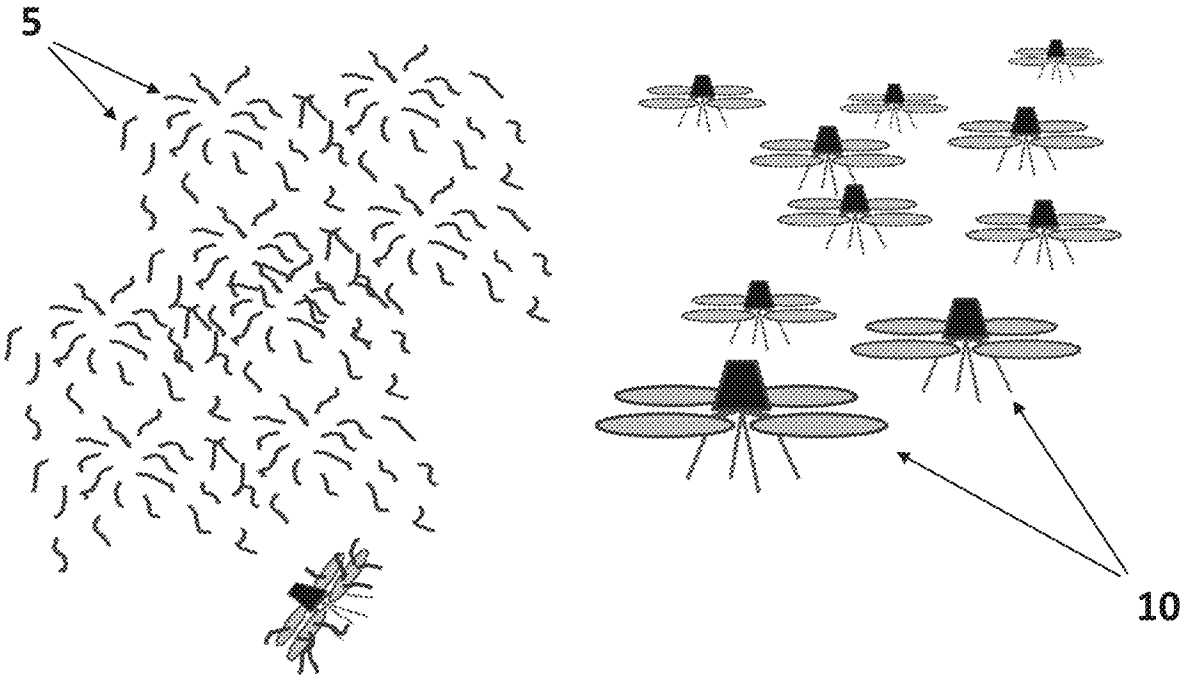
FIG. 1*a* illustrates an exemplary situation pursuant to one or more embodiments herein, wherein fibrous occlusive interruption of lift is applied to defeat an attempted attack by multiple UAVs
Figure 1C:
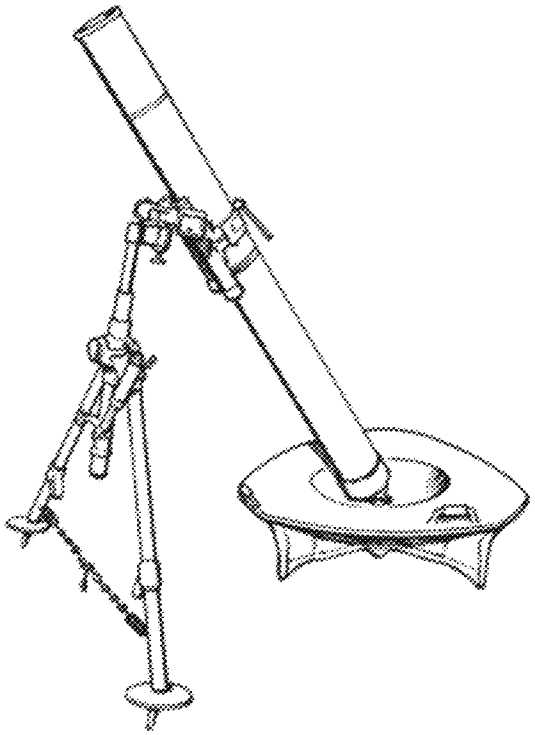
FIGS. 1*b* and 1*c* illustrate exemplary deployment devices for deploying fibrous occlusive material in accordance with one or more embodiments herein.
Figure 1B:
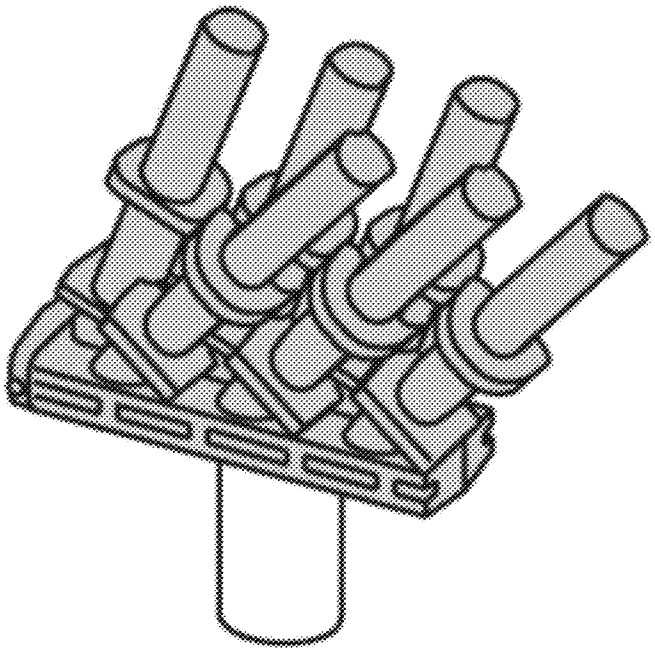

The Fibrous Occlusion of and Interruption of Lift (FOIL) system discussed herein can be used to defeat a single UAV or a swarm of UAVs. In one embodiment, a cloud of fibers are deployed and become entangled with the UAVs propeller (s), reducing or eliminating its thrust by occlusion and causing the UAV to lose the ability to stay aloft. A schematic of this embodiment is shown in FIG. 1, where individual fibers 5 are deployed in the proximity of one or more UAVs 10.

Figure 2A:
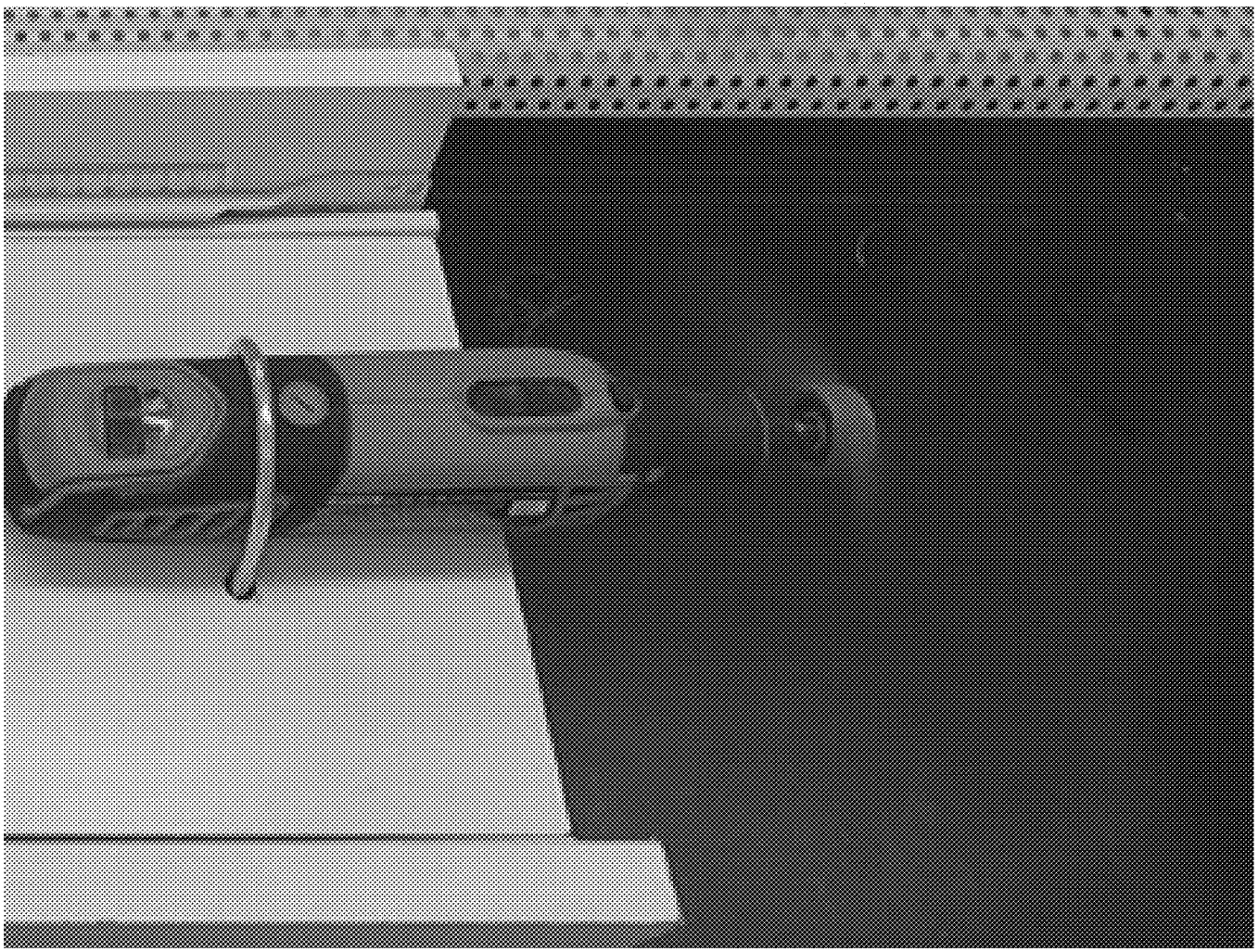
FIGS. 2*a*, 2*b*, 2*c* illustrate aspects of a demonstration showing use of the FOIL fiber material to disrupt thrust generated by a propeller according to an embodiment described herein.
Figure 2B:
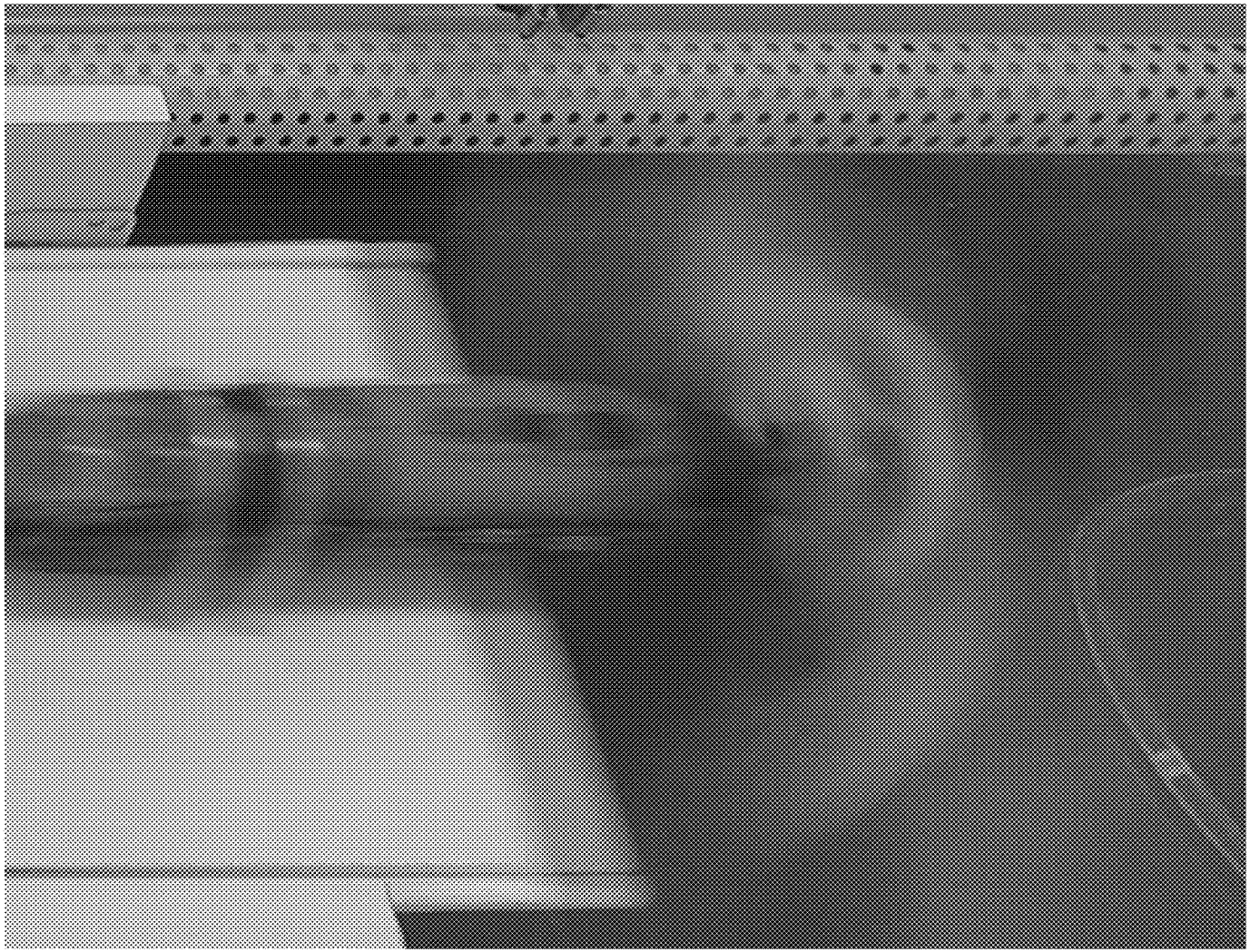
Figure 2C:
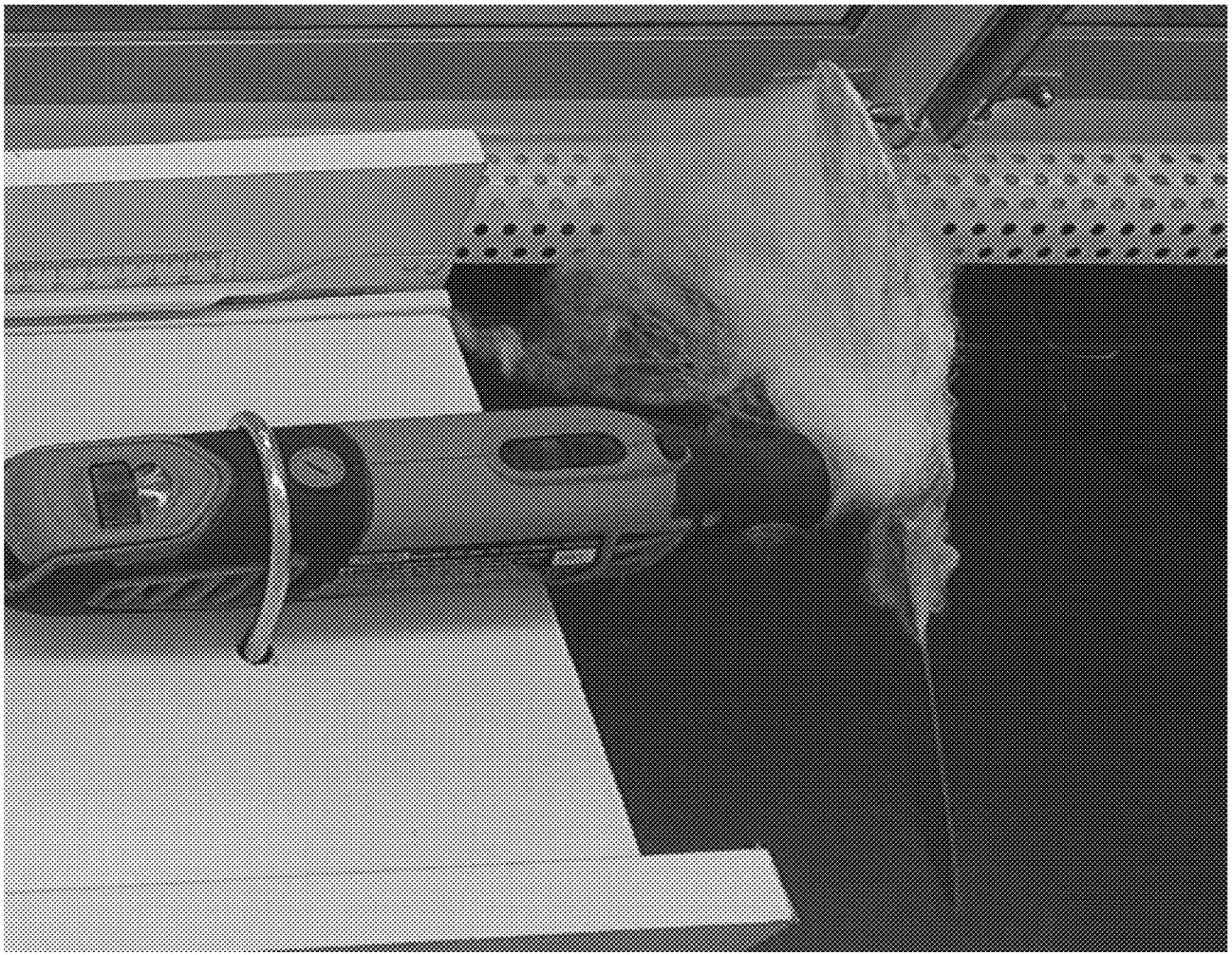

FIGS. 2*a* through 2*c* show a laboratory demonstration of reduction and eventual elimination of lift (or thrust) using a specific implementation of FOIL fibers. Specifically, in the laboratory demonstration a ten inch propeller is attached to a Dremel® tool and generates 2 pound thrust during operation. Various amounts of polyvinyl alcohol (PVA) fibers were introduced in the vicinity of the rotating propeller. At minimal amounts, e.g., less than 3 grams, the fibers disrupt the circulation around the airfoil as shown in FIG. 2*a*. Larger amounts of introduced fibers throw the propeller off balance as shown in the photograph in FIG. 2*b*. And at 3 grams of the fibers, thrust is reduced to zero as shown in FIG. 2*c*. The particular material, i.e., fibers, used in this demonstration are extruded PVA fiber that is about 20 microns in diameter.

During the test shown in FIGS. 2*a* through 2*c*, the vibrations caused the setup to walk around the bench. In addition to disrupting the propeller, the fibers can also wrap around the shaft of the propeller and mechanically reduce the speed of rotation. Polyvinyl alcohol is non-toxic, biodegradable and can be water soluble. The benign effect on the environment allows the system to be used without concern for detrimental effects, making for low regret use. The advantage of the cloud of fibers is that it does not need precise targeting information. A cloud of material can be effective on multiple UASs or when the location/path of a single UAS is not precisely known.

Figure 3:
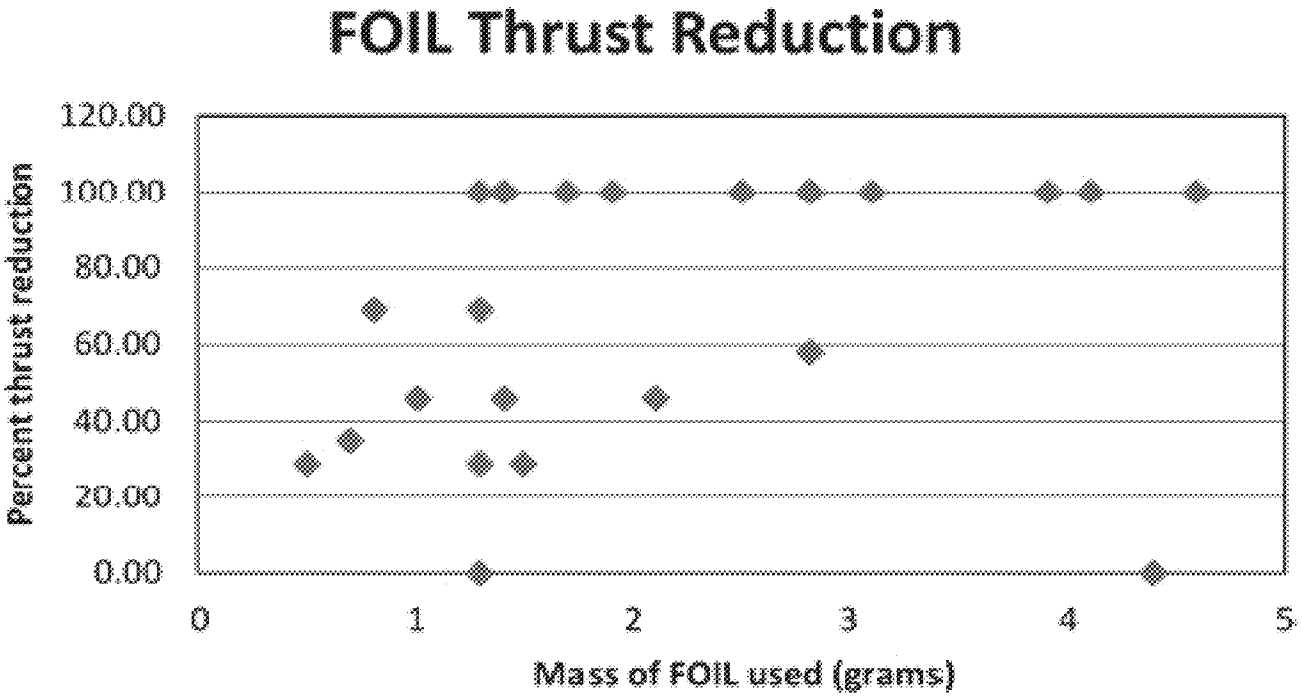
FIG. 3 shows data points from the demonstration illustrated in FIGS. 2*a*, 2*b*, 2*c;*

The material in the laboratory demonstration referenced herein is an extruded polyvinyl alcohol fiber that is about 20 microns in diameter with a cylindrical cross section. FIG. 3 graphs the reduction in thrust as a function of the mass of FOIL introduced into the propeller. There is a fair amount of scatter in the data for low amounts of FOIL. This is a result of natural variation and uncontrolled geometric variables. But above 3 grams of material, all thrust is eliminated if the propeller "catches" the material. As shown in FIG. 3, even small amounts of FOIL fibers, e.g., less than 1 gram, succeeded in reducing thrust. For the two points showing no thrust reduction, it was determined that none of the FOIL mass was captured by the propeller. In one embodiment a preferred length for the individual fibers is approximately the same as a diameter of the propeller of the device which is intended to be impeded by the fibers. One skilled in the art recognizes that there are numerous propeller diameters available in the art and propeller designs vary in accordance with size and weight, including anticipated payload, of the overall UAV.

The fiber material may be packaged and deployed using technologies such as pressurized canisters, pyrotechnic devices, drone carried dispersal devices, grenade or other pneumatic launchers or chaff launchers, either ground-based or hand-held. For example, the Mk137 chaff launcher shown in FIG. 1*b* has a range of 1.5 km and a payload of 12.7 kg and the M120 mortar shown in FIG. 1*c* has a range of 7 km and somewhat smaller payload. Other examples of possible deployment devices are the hand-held launchers described with reference to the OpenWorks Engineering SkyWall product and the Drone Defence Net Gun X1. One skilled in the art will appreciated the numerous existing deployment technologies which exist in the prior art. The deployment device must distribute the FOIL fibers throughout a 3-dimensional volume in the air.

While it is desirable for the fibers to resist movement through the air to remain aloft, they must move through the air to become a distributed cloud. In one embodiment, bomblets may be used to obtained sufficient distribution. Since the FOIL process and system produces a cloud of material to negate the UAVs, targeting does not need to be as precise as the net methods in the prior art. Further, the FOIL method allows for negation of multiple UAV targets, e.g., a swarm, in a concerted attack. In certain embodiments, it may be required to employ multiple shots of FOIL fibers, or deployment from a moving projectile, to make an expansive cloud that is capable of impeding a swarm or a UAV with unknown coordinates. Further still, since the FOIL method and system disrupts the UAV propulsion mechanism by mechanical means, the UAV's navigational systems and control need not be known or addressed as with the EM disruption processes referenced in the prior art.

While the fibers used in the test conducted in FIGS. 2*a* to 2*c*, are simple cylindrical cross sections, the embodiments are not so limited. Different fiber configurations may improve the characteristics necessary to keep the fiber material aloft and facilitate dispersion. Increasing the surface to volume ratio for the fiber should increase the time that it stays aloft. FIG. 4 shows shaped fibers which may be useful in the present embodiments. When the fibers are being extruded, they are also drawn which increases the strength but decreases the flexibility. The extent of draw also affects the fiber diameter or cross-sectional area. The material, cross section, shape and draw all affect the tensile strength and tenacity of the fibers.

Figure 5:
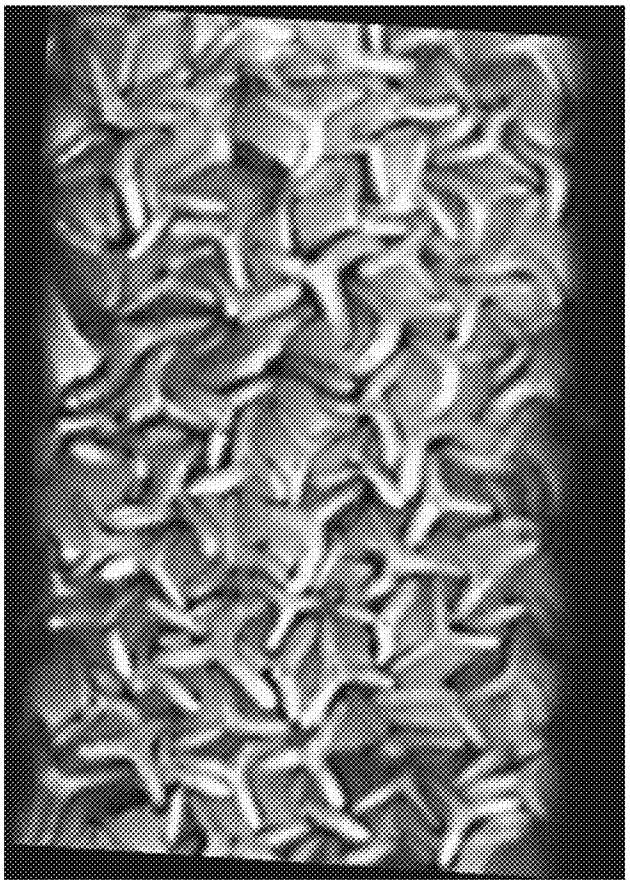
FIG. 5 shows a FOIL material cloud formed using trilobal fibers of FIG. 4*b*.

FIG. 5 shows how the trilobal-shaped fibers of FIG. 4*b* mesh together for enhanced adhesiveness to form a cloud of material and extend the time the material is aloft so as to increase chance of interaction with the UAV.

In a further embodiment, in order to facilitate a non-destructive or minimally-destructive negation of the UAV, e.g., facilitate soft landing, and/or to neutralize weaponry on a UAV (e.g., biological or chemical warfare agents), certain embodiments may utilize functionalized fiber particles or other materials that encapsulate the UAV with foam and or act to neutralize the weaponry. An exemplary foam material includes a polyurethane.

In various alternative embodiments, a single package of fiber material may be comprised of fibers having different lengths, different diameters, different cross sections and even different materials. This will increase the likelihood that the fiber material may be effective in disrupting UAV propellers having different diameters as exact UAV specifications may be unknown.

The selection of PVA or a PVA-containing material for the fiber construction is based, in part on the attributes of biodegradability as well as properties related to tensile strength, thermal stability and water-resistance which may be further controlled by virtue cross-linking. The following chapter from the book Biodegradable Polymers, Volume 1 by Nova Science Publishers, Inc. (2015) provides an extensive review of PVA and nanocomposites: "Polyvinyl Alcohol Based Biodegradable Polymer Nanocomposites," by Qiu et al. One skilled in the art will appreciate the properties of a PVA-containing material which will be most useful in the embodiments referenced herein. Additional information related to PVA-containing and other applicable materials is also found in co-owned U.S. patent application Ser. No. 15/071,279 entitled "Material for Propeller Occlusion of Marine Vessels," (hereafter '279 Patent Application) the contents of which is incorporated herein by reference.

The invention claimed is:

1. A process for interfering with the flight of one or more unmanned aerial vehicles (UAVs), comprising:

aiming a first deployment device in a direction of the one or more UAVs;

deploying by the first deployment device in the direction of the one or more UAVs a fiber material consisting of multiple individual, loose fibers, each of the multiple individual, loose fibers being formed of one or more biodegradable materials, wherein at least some portion of the multiple individual fibers are extruded fibers having a trilobal shape; the trilobal shape configured to enhance adhesiveness of the fiber material when deployed; the enhanced adhesiveness is effective to extend a time the fiber material is aloft so as to increase chance of interaction with one or more UAVs, and further wherein upon release from the first deployment device, the fiber material forms a cloud of multiple individual fibers, said cloud of multiple individual fibers physically interfering with a propeller system of the one or more UAVs and the physical interference of the fibers with the propeller system causing the one or more UAVs to lose the ability to remain aloft.

2. The process according to claim 1, wherein the one or more biodegradable materials includes polyvinyl alcohol (PVA).

3. The process according to claim 1, further comprising serially deploying by the first deployment device multiple clouds of multiple individual, loose fibers in a direction of the one or more UAVs.

4. The process according to claim 1, further comprising simultaneously deploying by multiple deployment devices multiple clouds of multiple individual, loose fibers in a direction of the one or more UAVs.

5. The process according to claim 1, wherein a diameter of at least some of each of the multiple individual fibers is approximately 20 microns.

6. The process according to claim 1, wherein a length of each of the multiple individual fibers is approximately equal to a diameter of one or more propellers of the propeller system of the one or more UAVs.

7. The process according to claim 1, wherein the fiber material includes individual, loose fibers having multiple lengths.

8. The process according to claim 1, wherein the fiber material includes individual, loose fibers having different diameters.

9. The process according to claim 1, wherein fiber material includes individual, loose fibers having different cross section patterns.

10. A system for interfering with the flight of one or more unmanned aerial vehicles (UAVs), comprising:

a deployment device;

a fiber material consisting of multiple individual, loose fibers formed of one or more biodegradable materials wherein at least some portion of the multiple individual fibers are extruded fibers having a trilobal shape; the trilobal shape configured to enhance adhesiveness of the fiber material when deployed; the enhanced adhesiveness is effective to extend a time the fiber material is aloft so as to increase chance of interaction with one or more UAVs, and wherein the fiber material is released from the deployment device forming a cloud of multiple individual fibers, said cloud of multiple individual fibers physically interfering with a propeller system of the one or more UAVs and the physical interference of the fibers with the propeller system causing the one or more UAVs to lose the ability to remain aloft.

11. The system according to claim 10, wherein the one or more biodegradable materials includes polyvinyl alcohol (PVA).

12. The system according to claim 10, wherein a diameter of at least some of each of the multiple individual fibers is approximately 20 microns.

13. The system according to claim 10, wherein a length of each of the multiple individual fibers is approximately equal to a diameter of one or more propellers of the propeller system of the one or more UAVs.

14. The system according to claim 10, wherein the fiber material includes individual, loose fibers having multiple lengths.

15. The system according to claim 1, wherein the fiber material includes individual, loose fibers having different diameters.

16. The system according to claim 1, wherein the fiber material includes individual, loose fibers having different cross section patterns.

17. The system according to claim 10, wherein the deployment device is ground-based.

18. The system according to claim 10, wherein the deployment device is airborne.

* * * * *